US007540937B2

(12) United States Patent
Snekkenes et al.

(10) Patent No.: US 7,540,937 B2
(45) Date of Patent: Jun. 2, 2009

(54) METHOD FOR CONTINUOUS COOKING

(75) Inventors: Vidar Snekkenes, Karlstad (SE); Lennart Gustavsson, Karlstad (SE); Jonas Saetherasen, Karlstad (SE)

(73) Assignee: Metso Fiber Karlstad AB, Karlstad (SE)

( * ) Notice: Subject to any disclaimer, the term of this patent is extended or adjusted under 35 U.S.C. 154(b) by 823 days.

(21) Appl. No.: 11/038,704

(22) Filed: Jan. 19, 2005

(65) Prior Publication Data

US 2005/0173081 A1 Aug. 11, 2005

(30) Foreign Application Priority Data

Feb. 9, 2004 (SE) ..... 0400253

(51) Int. Cl.
*D21C 11/00* (2006.01)
*D21C 11/06* (2006.01)

(52) U.S. Cl. ..... 162/29; 162/47

(58) Field of Classification Search ..... None
See application file for complete search history.

(56) References Cited

U.S. PATENT DOCUMENTS 6,203,662 B1 * 3/2001 Snekkenes et al. ..... 162/17

OTHER PUBLICATIONS

Grace et al., ed., Pulp and Paper Manufacture, 1983, Technical Section, Candian Pulp and Paper Association, vol. 5, 3rd. ed., p. 164.*

* cited by examiner

*Primary Examiner*—Philip C Tucker
*Assistant Examiner*—Michael J Felton
(74) *Attorney, Agent, or Firm*—Rolf Fasth; Fasth Law Offices

(57) ABSTRACT

A procedure for the continuous cooking of chemical pulp, comprising an impregnation vessel 101 and a digester 102. The chips are impregnated in the impregnation vessel 101and are fed after impregnation together with circulation fluid through a transfer line 103 to a top separator 105 on the digester 102 in order to be cooked. A fraction of the circulation fluid is withdrawn at a top separator 105 and returned to the bottom of the impregnation vessel 101 via a return line 106. Black liquor is withdrawn from the digester via a black liquor line 108 to the impregnation vessel 101.

The invention is characterized in that a heat exchanger 107is arranged between the return line 106 and the black liquor line 108. The heat exchanger 107 allows the exchange of heat between the two lines, but does not allow the exchange of fluid. The temperature of the black liquor in the black liquor line 108 after passing through the heat exchanger 107 has been cooled by 10-15 ° C.

8 Claims, 1 Drawing Sheet

METHOD FOR CONTINUOUS COOKING

PRIOR APPLICATION

This application is a U.S. national phase application claiming priority from Swedish Patent Application No. 0400253-1, filed 9 Feb. 2004.

TECHNICAL AREA

The present invention concerns a method for continuous cooking of cellulose pulp.

THE PRIOR ART

The withdrawal of consumed cooking fluid, known as black liquor, at the cooking temperature from various positions of the digester with a certain level of residual alkali during the continuous cooking of cellulose pulp in a two-vessel system, subsequently to lead the consumed cooking fluid after full or partial release of pressure, at a temperature of approximately 90-120° C., to an impregnation vessel for impregnation, is known, and is termed "black-liquor impregnation". The principal aim of this type of impregnation is to obtain an improved impregnation of alkali black liquor such that the chips are totally neutralised and given an alkali pH, and to achieve a high level of sulphide in the chips before the cooking, such that a pulp of higher quality is obtained.

A further aim is to be able to conserve to a greater degree the heat in the withdrawn cooking fluid in order to heat the colder chips in the impregnation vessel.

The conservation of part of the heat from the hot black liquor in association with black liquor impregnation is also known. This traditionally takes place through pressure reduction of steam using pressure-reduction cyclones, in a process in which this flash steam is used for, among other purposes, steam-treating the chips, or for other heating purposes.

A short black liquor impregnation at the top of the digester essentially at cooking temperature was used in the older methods of black liquor impregnation. It was considered to be advantageous to use a high temperature during the impregnation such that it should proceed rapidly and efficiently. An impregnation under countercurrent flow was considered to be particularly advantageous for a thorough impregnation.

The trend in recent years has been to impregnate using black liquor at a lower temperature and with a greater part of the impregnation under concurrent flow and for a longer period, typically 60-120 minutes. One of the major advantages of this is that the amount of xylan released becomes lower with lower temperatures. Cooling of the withdrawn cooking fluid (the black liquor) has for this reason been necessary, and this has taken place either through flashing or through cooling in a heat exchanger with water as cooling agent.

However, a lower temperature during the impregnation involves the need to warm the chips when they proceed from the impregnation vessel to the digester. This has been solved through heaters in the transfer flow. Heat exchangers with steam as the heating agent have been most often used as heaters. This method requires considerably energy, and for each cubic meter of steam that is used for this purpose, the possible production of electrical power from the steam is reduced. It is therefore desirable to discover methods that allows impregnation at low temperature in which the heat in the black liquor can be conserved and passed to the digester without these energy losses arising, or at least, being reduced to a minimum.

The Swedish patent SE 518 957 reveals a continuous cooking process with the aim of improving the heat economy in association with black liquor impregnation, that wholly or partially removes the problems and disadvantages described above.

Black liquor, the pressure of which has not been fully released, is passed in this patent into the lower zone of the impregnation vessel in order to increase the temperature of the chips before the digester. Parts of the black liquor are withdrawn at the top separator above the digester and returned to the impregnation zone of the impregnation vessel. In this way, the hot black liquor participates in increasing the temperature of the chips before their transfer to the digester, whereby the requirement for heating at the top of the digester is lowered.

SE 502 134 reveals a method for optimising the fluid/wood ratio in impregnation vessels and digesters. The liquor in the transfer circulation is partially separated in the top separator of the digester and mixed with an amount of cooking fluid withdrawn from the digester from a strainer section at a lower level in the digester. This mixture of liquor is led together through a heat exchanger for heating back to the outlet arrangement at the bottom of the impregnation vessel. However, a subsidiary current of this impregnation fluid is led without being heated to the top of the impregnation vessel in order for a higher fluid/wood ratio to be obtained at the top of the impregnation vessel. One of the advantages is, according to the patent, that the flow of steam for heating at the top of the digester can be somewhat reduced in that the temperature is higher in the transfer.

The disadvantage of this patent is that the levels of residual alkali in the return liquor from the top separator and from the strainer section lower down in the digester should not deviate by too large a degree. If the residual alkali levels in these two flows deviates by too large a value, a resulting mixture of return liquor is obtained that has neither a "high" level of residual alkali nor one that is sufficiently "low" for it to be sent for recovery. This gives rise to large differences in the level of residual alkali, something that means that batchwise addition of alkali and its profile cannot be optimised, and that there is a risk that the addition of fresh alkali passes directly to recovery without having had a substantial retention time in the cooking system.

AIM AND BRIEF DESCRIPTION OF THE INVENTION

The principal aim of the present invention is to achieve a continuous cooking process with an improved heat economy, and:

- to impregnate at a lower temperature, for a long time and where a sufficient quantity of alkali is included in the impregnation fluid, with the aim of retaining the xylan in the cellulose;
- that the chips are warmed at the bottom of the impregnation vessel in order to reduce the requirement for steam at the top of the digester;
- to achieve a good alkali profile for the impregnation vessel and the digester;
- that separation of partially consumed cooking fluid and totally consumed cooking fluid can be achieved, such that only partially consumed cooking fluid is used for black liquor impregnation in which the consumption of alkali is high, and;
- that addition of fresh white liquor at the top of the digester is prevented from being drawn to recovery with only a short retention time in the system, something that gives a high efficiency of the batchwise addition of alkali.

A method for the continuous cooking of cellulose in a two-vessel cooking system is offered through the present invention where impregnation takes place in an impregnation fluid that at least partially comprises withdrawn partially consumed cooking fluid at the cooking temperature from the digester, otherwise known as "black liquor". The method makes it possible to impregnate at low temperatures in agreement with the most recent development within the field of black liquor impregnation, while at the same time the need for cooling of the black liquor to the impregnation vessel is reduced or eliminated.

The method also reduces or eliminates the need for heating in the transfer line between impregnation vessel and digester, which indirectly reduces the consumption of pure steam or flash steam which can, thus, be used at another location, while it reduces the need of supplementary steam addition at the top of the digester in order to raise rapidly the temperature of the chips to the cooking temperature. The method, considered comprehensively, provides an improved energy economy relative to that which is previously known in that the energy losses that unavoidably arise when carrying out heat-exchange with steam, flashing, etc., are reduced.

Furthermore, the method provides a good alkali profile not only for impregnation but also for cooking. This is particularly true for cooking processes in which the difference in the levels of residual alkali in the circulation fluid in the return line from the top separator to the bottom of the impregnation vessel and the withdrawn cooking fluid (known as black liquor) from the digester to the upper part of the impregnation vessel is at least 10 g/l.

DETAILED DESCRIPTION OF THE INVENTION

Figure 1:
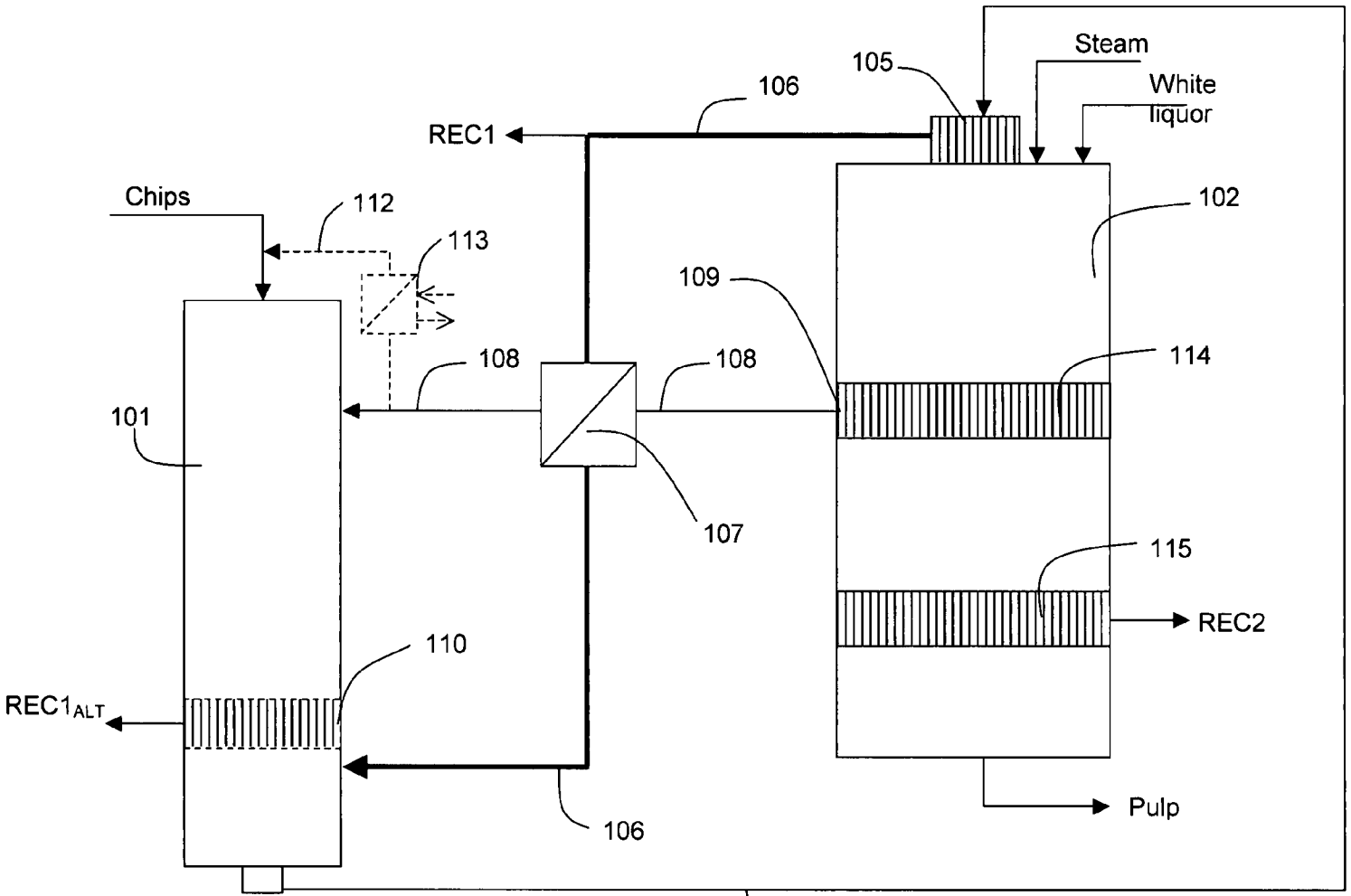
FIG. 1 shows schematically one preferred embodiment of a two-vessel cooking plant in which the application is applied.

The concept of "black liquor" will be used in the description below. "Black liquor" is here taken to denote consumed or partially consumed cooking fluid that is withdrawn from the digester 102 at a cooking temperature in the interval 130-160° C., typically 140° C., and in which the level of residual alkali is suitably greater than 20 g/l. However, in order to be characterised as black liquor, the withdrawal must take place after cooking for at least 30 minutes, preferably after 45 minutes. One skilled in the arts will realise that the position of the withdrawal will vary, depending on the particular cooking method and the cooking conditions associated with it, and this position can thus comprise a withdrawal at the beginning, in the middle, or at the end of the digester in a zone of concurrent flow or of countercurrent flow, or as a withdrawal between an upper zone of concurrent flow and a subsequent zone of countercurrent flow. More than one withdrawal may also be used.

Furthermore, the concepts "recovery REC1", "recovery REC$\mathbf{1}_{ALT}$", "recovery REC2" and "recovery RECtot" will be used.

"REC1" is here used to denote a portion of the circulation fluid in the return line 106 from the top separator 105 to the bottom of the impregnation vessel, and where this portion is directly forwarded to recovery or is forwarded indirectly to recovery via impregnation.

"REC$\mathbf{1}_{ALT}$" is here used to denote an alternative embodiment to that of REC1, in which a portion is instead withdrawn from the impregnation vessel.

"REC2" is here used to denote a withdrawal of fluid that is withdrawn from the digester 102 and where this fluid is forwarded to recovery.

"RECtot" is here used to denote the total quantity of all fluids that are forwarded from the digester 102 for recovery or for impregnation.

Finally, the concepts "first level of residual alkali" and "second level of residual alkali" will be mentioned. "First level of residual alkali" is here used to denote the level of residual alkali of the withdrawn partially consumed cooking fluid, known as black liquor", that is carried out at a withdrawal position 109 through a withdrawal strainer 114 into the black liquor line 108. "Second level of residual alkali" is here used to denote the level of residual alkali in the withdrawal of circulation fluid that is carried out via the top separator 105 into the return line 106.

FIG. 1 shows schematically a method for a continuous two-vessel digestion plant for the production of cellulose pulp in which the invention is applied and where the cooking system comprises an impregnation vessel 101 and a digester 102. The digester 102 is of steam/fluid phase type, with a top separator 105 at the top, but the invention can also be applied at a hydraulic cooking system with separation of the chips and the transport fluid in a strainer section at the top of the digester.

The impregnation vessel 101 has an inlet at which chips together with process fluid (chip moisture, any condensate from a preceding steaming if this is used, and a certain addition of alkali for the purposes of adjustment) are fed into the vessel 101 for impregnation of the chips at a predetermined impregnation temperature, $T_{imp}$, that lies in the interval 100-140° C.

The consumption of alkali in the impregnation vessel 101 is at least 60 kg NaOH per tonne of wood, and this requires a retention time of at least 40 minutes and typically in the interval 40-120 minutes. The greater part of the alkali is consumed in neutralising the naturally acidic chips and in establishing an alkali pH for the complete chip section. A minor fraction of the delignification also takes place during the impregnation, but only a negligible fraction of the bulk delignification.

The impregnated chips are fed together with circulation fluid into a transfer line 103 to the top separator 105 on the digester 102. The chips are cooked in the digester 102 at a predetermined temperature, $T_{dig}$, that lies in the interval 130-180° C.

In all conditions according to the invention $T_{imp}$ is at least 20-30° C. lower than $T_{dig}$.

Once the impregnated chips have been transported in the transport line 103 from the impregnation vessel 101 to the top separator 105, a portion of the circulation fluid is withdrawn at the top separator 105 and this portion is returned to the bottom of the impregnation vessel via a return line 106. This withdrawal of circulation fluid in the return line 106 has a second level of residual alkali. This second level of residual alkali lies in the interval 5-10 g/l and is directly suitable for sending directly to recovery.

At the top of the digester (following, or in association with, the outlet from the top separator) the quantity of white liquor that is required for the bulk delignification phase is subsequently added. Typically, a quantity of fresh alkali (white liquor) is added such that the level of $OH^-$ increases by at least 10 g/l and/or equivalent to at least 50% of the total addition of fresh white liquor for impregnation and digestion. The total batch of alkali (both alkali from the fresh white liquor and residual alkali in the accompanying black liquor) at the top of the digester is greater than 100-120 kg NaOH per tonne of wood. At least one withdrawal of partially consumed cooking fluid, known as black liquor, is carried out from the digester 102 at at least one withdrawal strainer 114 at withdrawal location 109 to a black liquor line 108, and this withdrawal is led to the upper section of the impregnation vessel 101. The black liquor from the black liquor line 108 contributes to a f/w ratio (a fluid/wood ratio) that exceeds 4, preferably one that exceeds 5, being established in the impregnation vessel 101. This withdrawal of black liquor essentially maintains at the withdrawal location 109 the cooking temperature, $T_{dig}$, and full cooking pressure, and it contains a first level of residual alkali. It is appropriate that this first level of residual alkali is higher than 20 g/l. This black liquor with a first level of residual alkali is withdrawn from the digester after a retention time for the pulp in the digester of at least 30 minutes, preferably longer than 45 minutes. More than 40% of the f/w ratio in the impregnation vessel 101 is obtained from this black liquor in the black liquor line 108. For all cooking conditions according to the invention, the first level of residual alkali in the hot black liquor in the black liquor line 108 after its withdrawal is at least 10 g/l higher than the second level of residual alkali in the return line 106 of the circulation fluid.

A heat exchanger 107 is arranged between the return line 106 and the black liquor line 108 that allows heat exchange, without allowing exchange of fluid, between the return line 106 and the black liquor line 108. After passage of the black liquor through the heat exchanger 107, the temperature of the black liquor in the black liquor line 108 has been reduced by 10-15° C. The temperature of the circulation fluid in the return line 106 has been raised by an amount that is equivalent to the amount of energy that has been released by the cooling of the black liquor in the black liquor line 108.

The temperature difference in the return line 106 is small due to the flow from the circulation fluid in the return line 106 in the heat exchanger 107 being very much greater than the flow of black liquor in the black liquor line 108. The flow in the return line is typically at least 3-5 times greater than the flow in the flow of the chips mixture through the impregnation vessel. The withdrawal flow of black liquor in the black liquor line 108 is, in turn, often less than 50% of the flow in the chips mixture down through the impregnation vessel 101. On the other hand, the rise in temperature over the system, that is, the rise in the temperature of the chips from the impregnation vessel to the top of the digester, is greater when measured in terms of the number of Celsius degrees through which the temperature of the chips is raised.

Before the circulation fluid in the return line 106 is heated in the heat exchanger 107, more than 1 $m^3$/tonne wood is withdrawn at the recovery REC1, and/or at least 25% of the total quantity that is sent to recovery, RECtot.

It may be possible to replace this withdrawal location by a withdrawal strainer 110 at the bottom of the impregnation vessel, which is, actually, a conventional withdrawal location in older two-vessel systems.

At a location in the digester 102 at which the pulp has had a retention time in the digester that significantly exceeds the retention time for the withdrawal of black liquor at the withdrawal location 109, by at least 60 minutes, it is appropriate that a withdrawal of fluid is carried out for recovery REC2 via a withdrawal strainer 115.

Further fluid circulations may, possibly, be arranged within the digester with heating or with adjustment of the cooking fluid, where certain of these may involve partial withdrawal of consumed cooking fluid.

The use of the heat exchanger 107 to heat the circulation fluid in the return line 106 by direct heating and simultaneously cool the black liquor in the black liquor line 108 allows the following positive effects to be achieved:

An improved heat economy at the given process conditions (time and temperature in the various zones).

The chips at the bottom of the impregnation vessel are heated before the transfer line 103, as a result of which the quantity of steam required to heat the chips at the top of the digester can be significantly reduced.

The temperature is held at a low value during the main part of the impregnation, something that is advantageous for the impregnation and that reduces the quantity of xylan released.

The alkali levels of the circulation fluid in the return line 106 and of the black liquor in the black liquor line 108 are unchanged following the exchange of heat between these two, where the one fluid has a higher alkali level and a reduced temperature suitable for the impregnation, and the second fluid has a lower alkali level and a higher temperature, with the principal aim of heating the chips during the shorter retention time in the transfer system.

The invention is not limited to the embodiments described, and several variants are possible within the scope of the claims.

For example, a second cooler can be located arranged after the heat exchanger if it is required to reduce the temperature of the black liquor further. It is appropriate that a fraction of the cooled black liquor can be added at the inlet to the impregnation vessel, as is suggested in FIG. 1 by the dashed flow 112. The second cooler 113 can be installed instead in this flow.

The withdrawal strainer 114 can also be in the form of several withdrawal strainers placed at different heights in the digester, where the level of residual alkali of the mixture obtained by the withdrawal flow from these strainers can form the required "high" level of residual alkali.

While the present invention has been described in accordance with preferred compositions and embodiments, it is to be understood that certain substitutions and alterations may be made thereto without departing from the spirit and scope the following claims.

The invention claimed is:

1. A method for the continuous cooking of cellulose pulp, comprising:

providing an impregnation vessel in fluid communication with a digester, feeding a mixture of chips and process fluid to the impregnation vessel, impregnating the chips at a predetermined impregnation temperature $T_{imp}$, feeding the impregnated chips together with a circulation fluid through a transfer line to a top separator on the digester, cooking the chips at a predetermined cooking temperature, $T_{dig}$, where $T_{imp}$ is at least 20° C. lower than $T_{dig}$, withdrawing a fraction of the circulation fluid at the top separator, returning the circulation fluid to a bottom of the impregnation vessel via a return line, withdrawing black liquor from the digester at a withdrawal location to a black liquor line that essentially maintains the cooking temperature, $T_{dig}$, and essentially a full digester pressure with a first level of residual alkali, providing a heat exchanger in direct operative engagement with both the return line and the black liquor line for exchanging heat between the return line and the black liquor line, the heat exchanger cooling the black liquor in the black liquor line by 10-15 ° C. after passing through the heat exchanger, withdrawing more than 1 $m^3$/ton wood and/or at least 25% of a total withdrawal for recovery ($REC_{tot}$) from the circulation fluid for recovery ($REC_1$), the heat exchanger heating the circulation fluid in the return line, leading the black liquor in the black liquor line to an upper section of the impregnation vessel after passing through the heat exchanger, the black liquor contributing to an establishment of a fluid-to-wood (f/w) ratio that exceeds 4 in the impregnation vessel, obtaining more than 40% of the f/w ratio in the impregnation vessel from the black liquor in the black liquor line, providing the circulation fluid in the return line with a second level of residual alkali, ensuring that the first level of residual alkali is at least 10 g/l higher that the second level of residual alkali, and consuming at least 60 kg NaOH per ton of wood of alkali in the impregnation vessel.

2. The method according to claim 1 wherein the first level of residual alkali is greater than 20g/l.

3. The method according to claim 2 wherein the first level of residual alkali is withdrawn from the digester after a retention time in the digester of at least 30 minutes.

4. The method according to claim 2 wherein the second level of residual alkali lies within an interval of 5-10 g/l.

5. The method according to claim 4 wherein the chips are given a retention time during the impregnation of at least 40 minutes in the impregnation vessel.

6. The method according to claim 1 wherein white liquor is added at a top of the digester, the addition of white liquor increases a quantity of $OH^{31}$ by at least 10 g/l and/or is equivalent to at least 50% of a total addition of white liquor for impregnation and cooking.

7. The method according to claim 1 wherein a withdrawal of fluid for recovery (REC2) is carried out from a location in the digester at which the pulp has had a retention time in the digester that exceeds a retention time for the withdrawal of black liquor at the withdrawal location by at least 60 minutes.

8. A method for the continuous cooking of cellulose pulp, comprising:

providing an impregnation vessel in fluid communication with a digester, feeding a mixture of chips and process fluid to the impregnation vessel, feeding the impregnated chips together with a circulation fluid through a transfer line to a top separator on the digester, cooking the chips in the digester, withdrawing a fraction of the circulation fluid at the top separator, returning the fraction of the circulation fluid to a bottom of the impregnation vessel via a return line, withdrawing black liquor from the digester at a withdrawal location to a black liquor line, providing a heat exchanger in direct operative engagement with both the return line and the black liquor line for exchanging heat between the return line and the black liquor line, the heat exchanger cooling the black liquor in the black liquor line after passing through the heat exchanger, the heat exchanger heating the circulation fluid in the return line, and leading the black liquor in the black liquor line to an upper section of the impregnation vessel after passing through the heat exchanger.

* * * * *